US005593106A

United States Patent [19]

Cavanagh

[11] Patent Number: 5,593,106

[45] Date of Patent: Jan. 14, 1997

[54] SURFACE WINDER

[75] Inventor: Kenneth M. Cavanagh, Warwick, R.I.

[73] Assignee: Parkinson Machinery and Manufacturing Corp., Woonsocket, R.I.

[21] Appl. No.: 567,888

[22] Filed: Dec. 8, 1995

[51] Int. Cl.[6] ..... B65H 18/20; B65H 19/26; B65H 19/30

[52] U.S. Cl. ..... 242/527; 242/541.6; 242/542; 242/542.3; 242/533.2

[58] Field of Search ..... 242/527, 541.5, 242/541.6, 542, 542.2, 542.3, 533, 533.2, 542.1

[56] References Cited

U.S. PATENT DOCUMENTS

| | | | |
|---|---|---|---|
| 2,989,262 | 6/1961 | Hornbostel | 242/542 |
| 3,345,010 | 10/1967 | Egan | 242/541.5 |
| 3,817,467 | 6/1974 | Dambroth | 242/533.2 |
| 5,544,841 | 8/1996 | Didier et al. | 242/542.3 |

*Primary Examiner*—John M. Jillions
*Attorney, Agent, or Firm*—Samuels, Gaunthier, Stevens & Reppert

[57] ABSTRACT

An apparatus for continuously winding web material into a succession of rolled packages includes spaced side frames which define a transfer path leading from a first winding station to a second winding station. A plurality of rotatably driven winding drums extend between the side frames and support the cores and packages wound thereon during a winding operation which begins at the first winding station and continues during transfer of the cores to the second winding station. Tracks are fixed to the side frames which mount a transfer carriage movable on the tracks between the first and second winding stations. A first hold down mechanism and a first rider roll are carried by the carriage and a second hold down mechanism and second rider roll are located at the second winding station. The first hold down mechanism engages grooves in the ends of mandrels which are inserted into the cores to axially stabilize the mandrels. Both the first and second hold down mechanisms are simultaneously engageable with the grooves in the mandrel ends during hand off from one to the other at the second winding station. The first rider roll is applied continuously at the first winding station and as the packages are shifted along the transfer path to the second winding station. Both the first and second rider rolls are simultaneously applied to packages at the second winding station. During transfer the nipping force is maintained within acceptable limits by adjusting the forces being applied to the package by the first hold down mechanism and the first rider roll.

13 Claims, 6 Drawing Sheets

SURFACE WINDER

BACKGROUND OF THE INVENTION

1. Field of the Invention

This invention relates to winders of the type employed in the paper, plastics, nonwoven and textile industries to wind web material into large rolled packages, and is concerned in particular with an improved surface winder for continuously winding such materials into a succession of packages.

2. Description of the Prior Art

In the conventional continuous surface winder, the winding operation commences at a first winding station where the web material begins to accumulate in a rolled package around a tubular core of cardboard or other like material. A mandrel is removably inserted in the core, and a so-called "rider roll" is yieldably applied to the package to stabilize the initial phase of the winding operation at the first Winding station. The winding operation continues as the package is shifted laterally along a transfer path from the first winding station to a second winding station. The winding operation is completed at the second winding station under the stabilizing effect of a second rider roll.

During its transfer from the first winding station to the second winding station, the package is carried on a plurality of rotatably driven winding drums which extend between rigid side frames in a cross machine direction perpendicular to the transfer path. The package is not stabilized by a rider roll during its transfer between winding stations. The ends of the mandrel protrude from opposite ends of the core, and are axially confined between wear plates fixed to the side frames. A first pivotal "hold down" mechanism yieldably urges the ends of the mandrel downwardly at and during transfer away from the first winding station. A second hold down mechanism is employed at the second winding station. At the conclusion of a winding operation, the web material is severed, the severed leading end is automatically applied to a fresh core at the first winding station, and the completed package of wound web material is cleared from the second winding station, as winding continues uninterruptedly at the first winding station.

Although conventional continuous surface winders operate in a generally satisfactory manner, the resulting edge profile of the rolled package sometimes lacks uniformity. Investigations have revealed that edge nonuniformity can be attributed to a number of factors, including axial drift of the supporting mandrels between misaligned non-parallel wear plates, binding of the mandrel ends between the wear plates during transfer between the winding stations, unacceptable variations in the nipping force with which the package is held against the winding drums, the absence of the stabilizing effect of a rider roll during transfer of the package between the first and second winding stations, and an interruption of hold down forces during the "hand off" from the first hold down mechanism to the second hold down mechanism.

The objective of the present invention is to overcome the inherent limitations and deficiencies of conventional continuous surface winders, thereby making it possible to substantially improve the edge profiles of the resulting rolled packages.

SUMMARY OF THE INVENTION

According to one aspect of the invention, the first rider roll is mounted on a transfer carriage movable between the first and second winding stations along the transfer path. The first rider roll is applied continuously not only at the outset of the winding operation at the first winding station, but also thereafter as the transfer carriage follows the package as it is shifted along the transfer path to the second winding station.

According to another aspect of the invention, the transfer carriage is movable along tracks supported on the side frames. The transfer carriage is fixed against shifting in the cross machine direction relative to one of the tracks, but is free to move relative to the other track in that direction. The first hold down mechanism is carried on and extends downwardly from the carriage to engage grooves in the mandrel ends. The mandrel is thus axially stabilized with respect to only one of the tracks. This eliminates the necessity of maintaining both tracks in parallel alignment, and also eliminates the need for wear plates to axially confine the mandrel ends.

According to another aspect of the invention, during transfer of the package from the first winding station to the second winding station, the nipping force between the package and the winding drums is maintained within acceptable limits by adjusting the forces being applied to the package by the first hold down mechanism and the first rider roll. Such adjustments take into account variables such as the different radii of the winding drums, and the increasing weight and radius of the package.

According to still another aspect of the invention, both the first and second hold down mechanisms are simultaneously engageable with the grooves in the mandrel ends during hand off from one to the other. The resulting uninterrupted stabilizing effect further contributes to improved edge profile.

These and other features and advantages of the present invention will become more apparent as the description proceeds with the aid of the accompanying drawings, wherein:

DETAILED DESCRIPTION OF PREFERRED EMBODIMENT

Figure 1:
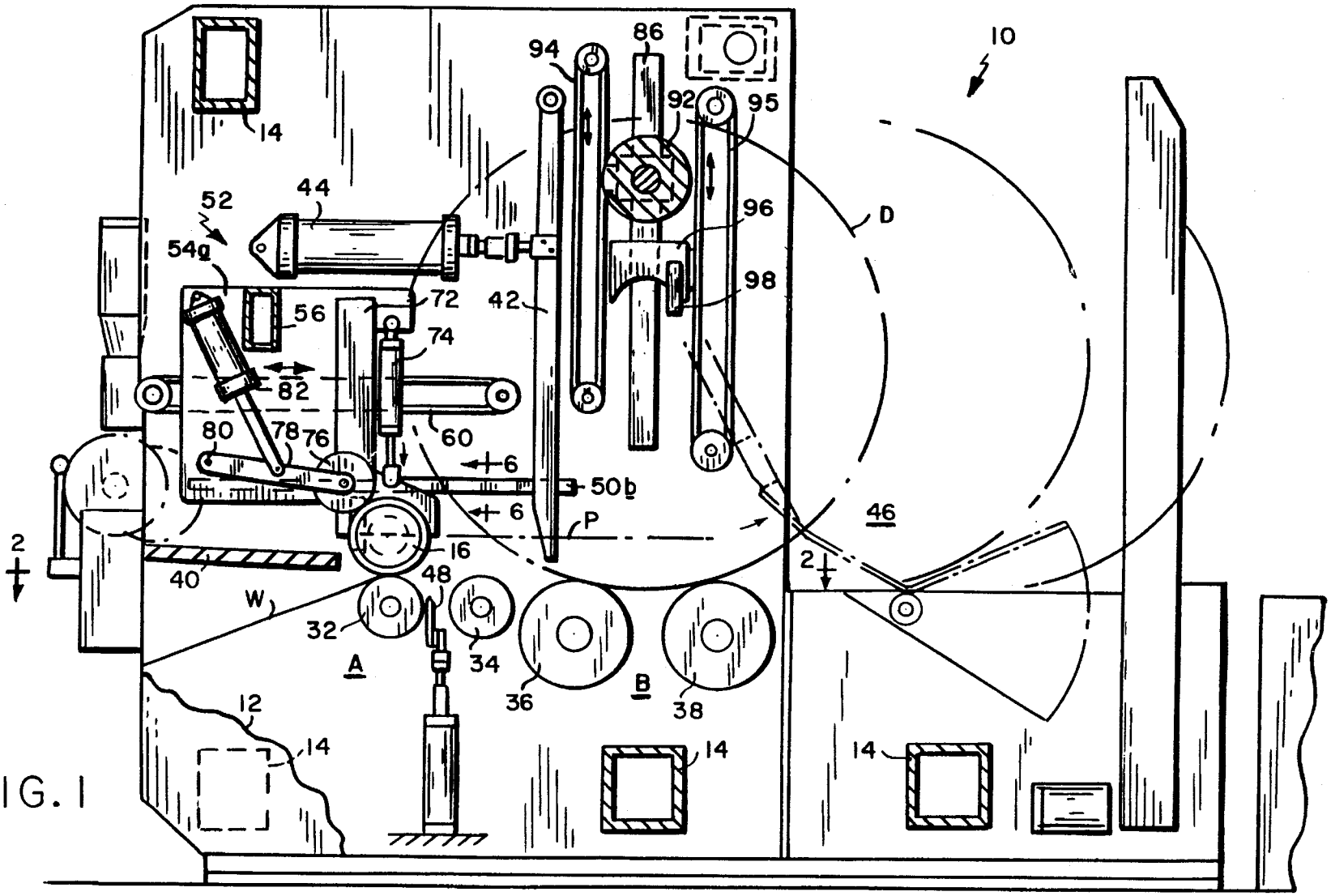
FIG. 1 is a side view with portions broken away schematically depicting the principal components of a continuous surface winder embodying the concepts of the present invention.
Figure 2:
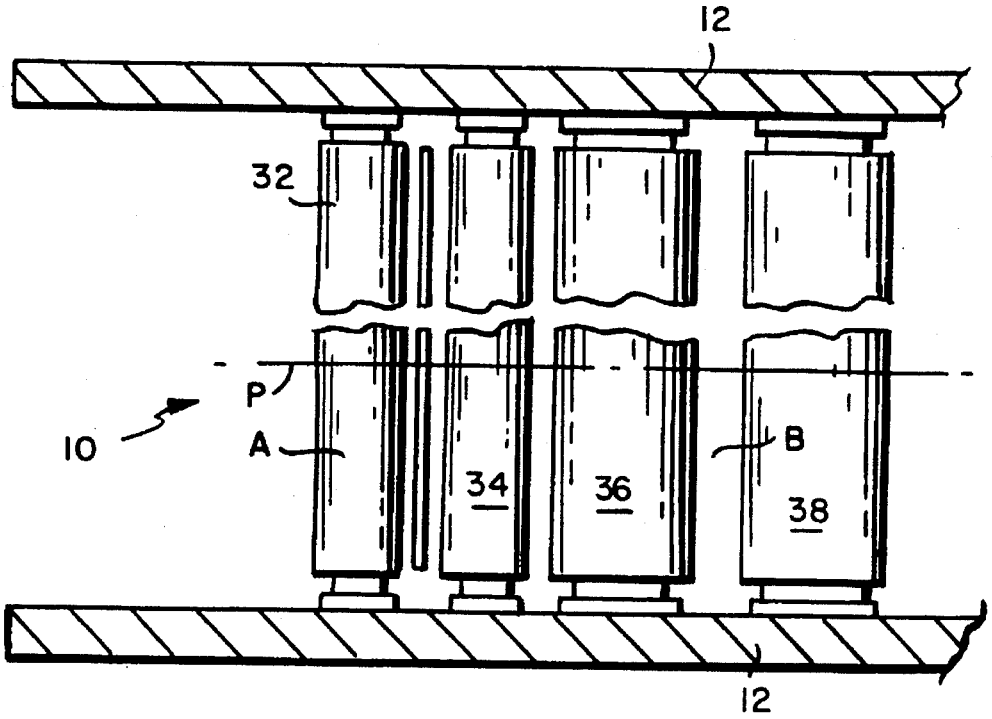
FIG. 2 is a partial horizontal sectional view taken along line 2—2 of FIG. 1.

Referring initially to FIGS. 1 and 2, a continuous surface winder according to the present invention is shown at 10. The surface winder has a basic support structure including fixed mutually spaced side frames 12 rigidly interconnected by cross beams 14. The side frames extend along opposite sides of a transfer path "P" leading from a first winding station "A" to a second winding station "B".

Figure 3:
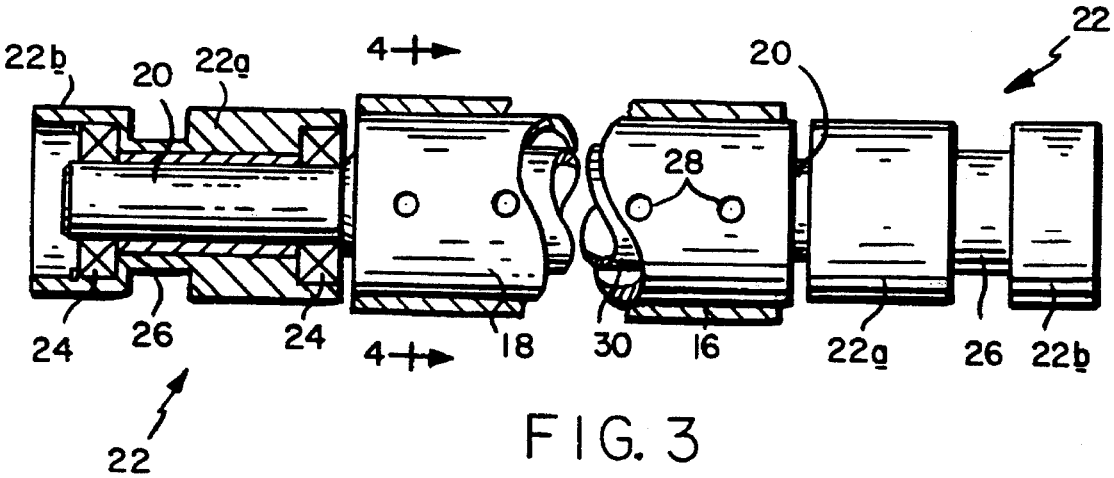
FIG. 3 is a foreshortened partially broken away view of a core member mounted on a support mandrel.
Figure 4:
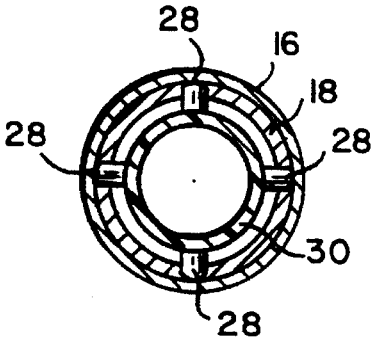
FIG. 4 is a sectional view taken along line 4—4 of FIG. 3.

The winder serves to wind web material "W" continuously onto a succession of tubular cores 16. As can best be seen in FIGS. 3 and 4, hollow mandrels 18 are inserted through and removably fixed relative to the cores 16. The mandrels have reduced diameter necks 20 which protrude from opposite ends of the cores. The protruding mandrel necks support sleeves 22 which are rotatable on bearings 24. The sleeves 22 are subdivided into inboard and outboard segments 22*a*, 22*b* by external grooves 26.

The barrels of the mandrels are hollow, and are provided with buttons 28 which are radially expandable to engage the interiors of the cores 16, thus rotatably fixing one with respect to the other. Expansion of the buttons can be achieved by any known means, such as for example inflatable pressure tubes 30 extending through the barrel interiors.

With reference again to FIGS. 1 and 2, it will be seen that a plurality of winding drums 32, 34, 36 and 38 extend between the side frames 12 in a cross machine direction perpendicular to the transfer path P. The winding drums are rotatably driven by conventional means (not shown) in a manner well known to those skilled in the art. The winding drums rotatably support the cores 16 and the web material being wound thereon during a winding operation which begins at the first winding station A and which continues during transfer along path P to the second winding station B where the winding operation is completed. The trajectory of the core axis during transfer between stations A and B is diagrammatically depicted in FIG. 7 at "T", and the final diameter of a finished package is shown at "D" in FIG. 1.

Fresh cores with mandrels inserted therein are delivered to the first winding station A on a downwardly sloping supply ramp 40, and a sweep arm 42 operated by a piston-cylinder unit 44 serves to remove fully wound packages from the second winding station B to a laterally adjacent delivery station 46. A piston-actuated cutter 48 severs the web at the conclusion of each winding operation at station B. The leading end of the severed web is automatically transferred in a known manner to a fresh core at the first winding station A to thereby allow winding of the next package to commence without interruption of web delivery to the winder.

Figure 5:
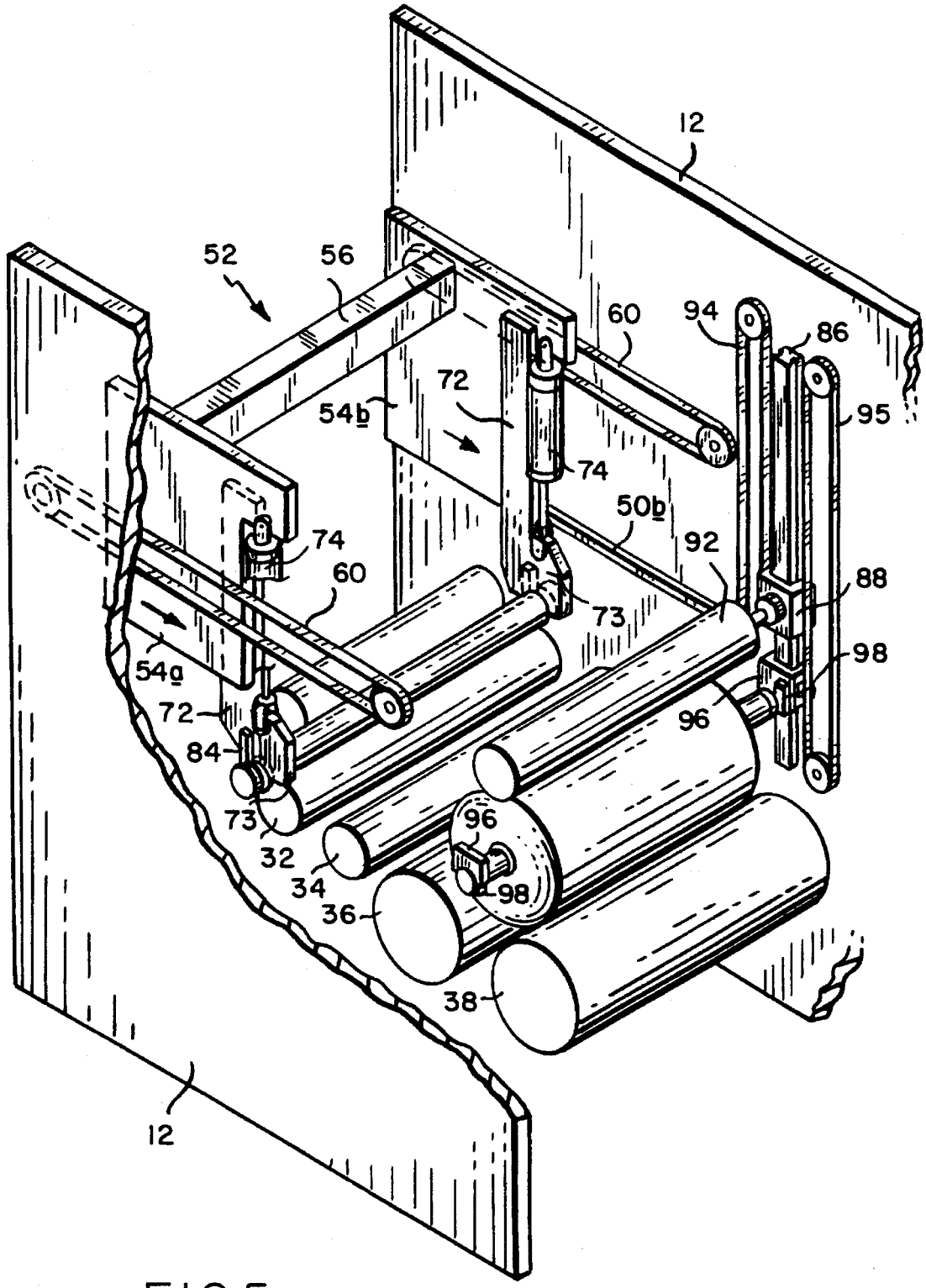
FIG. 5 is a three-dimensional view, with portions broken away, of the surface winder.
Figure 6:
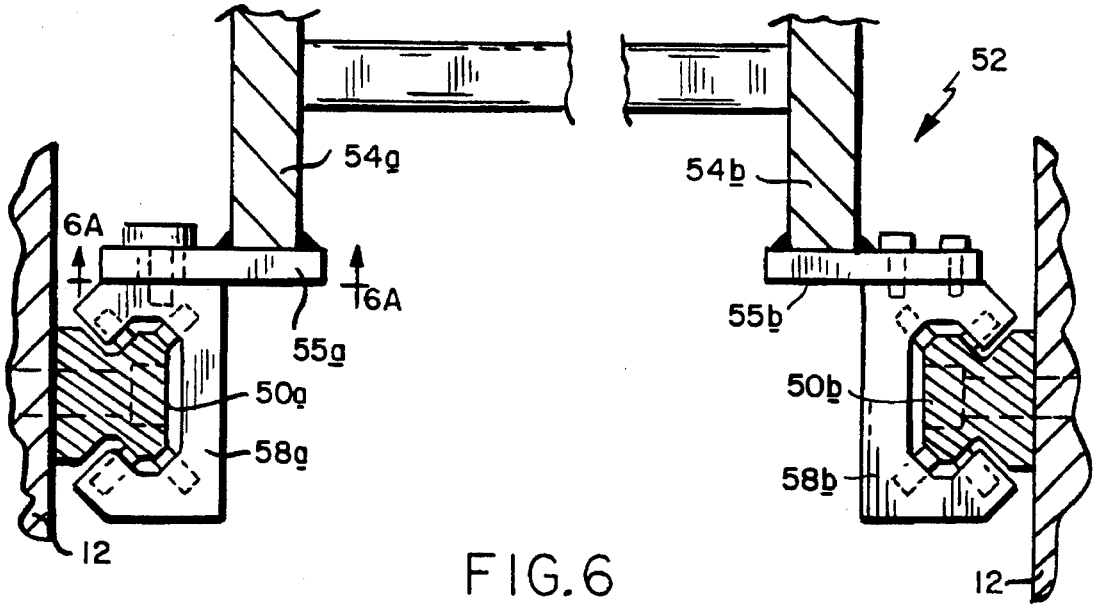
FIG. 6 is a sectional view on an enlarged scale taken along line 6—6 of FIG. 1.

With reference additionally to FIGS. 5 and 6, it will be seen that tracks 50*a*, 50*b* are fixed to the confronting interior sides of the side frames 12. A transfer carriage 52 is mounted on the tracks 50*a*, 50*b* for movement between the first and second winding stations A, B. The carriage 52 includes side plates 54*a*, 54*b* joined by a cross beam 56.

The carriage side plates 54*a*, 54*b* have respective foot plates 55*a*, 55*b* seated on linear roller bearings 58*a*, 58*b* which in turn are supported respectively on the tracks 50*a*, 50*b*.

The tracks 50*a*, 50*b* and bearings 58*a*, 58*b* may comprise components of the AccuMax Linear Roller Bearing System supplied by Thompson Industry, Inc. of Port Washington, N.Y. The bearings are freely movable along their respective tracks in the direction of the transfer path P, but are securely interengaged with the tracks against movement in the cross machine direction perpendicular to the transfer path.

Figure 6A:
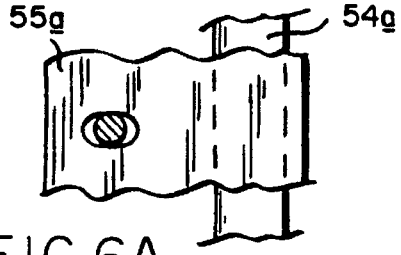
FIG. 6A is a sectional view taken along line 6A—6A of FIG. 6.

Foot plate 55*b* is secured against movement in the cross machine direction relative to the bearings 58*b*, whereas as shown in FIG. 6A, foot plate 55*a* is free to move or "float" in the cross machine direction relative to the bearings 58*a*.

A first hold down mechanism is associated with the transfer carriage 52. The first hold down mechanism comprises a pair of vertically adjustable slide plates 72 operated by piston-cylinder units 74. The slide plates have lowermost feet 73 with downwardly facing semi-circular lower edges adapted to engage the inboard segments 22*a* of the sleeves 22 on the ends of the mandrels 18. The first hold down mechanism operates to yieldably urge the mandrels downwardly towards the winding drums 32–38. A first rider roll 76 is also associated with the transfer carriage 52. The first rider roll is supported between a pair of arms 78 which are pivotally connected to the carriage side plates 54*a*, 54*b* as at 80. The arms 78 are pivotally manipulated by means of piston-cylinder units 82.

The feet 73 of the first hold down mechanism also include first keys 84 positioned for engagement within the grooves 26 and the mandrel end sleeves 22 when the feet 74 are engaged with the inboard sleeve segments 22*a*.

Vertically disposed guide tracks 86 are secured to the confronting surfaces of the side frames 12 at the second winding station B. Upper and lower linear bearings 88, 90 are mounted for vertical movement along the tracks 86. The tracks 86 and linear bearings 88, 90 may be of the same type as the previously described tracks 50*a*, 50*b* and bearings 58*a*, 58*b*. A second rider roll 92 is rotatably supported between the upper bearings 88. The upper bearings 88 are vertically adjustable along the tracks 86 by means of a belt drive 94. The lower bearings 90 support a second hold down mechanism in the form of plates 96 having semi-circular grooves in their lower edges adapted to engage the outboard segments 22*b* of the mandrel end sleeves 22. The plates 96 are provided with second keys 98 positioned to engage the slots 26 in the mandrel sleeves 22. The lower bearings 90 are vertically adjustable along the tracks 86 by means of a belt drive 95 which is operable independently of the belt drive 94.

Figure 7:
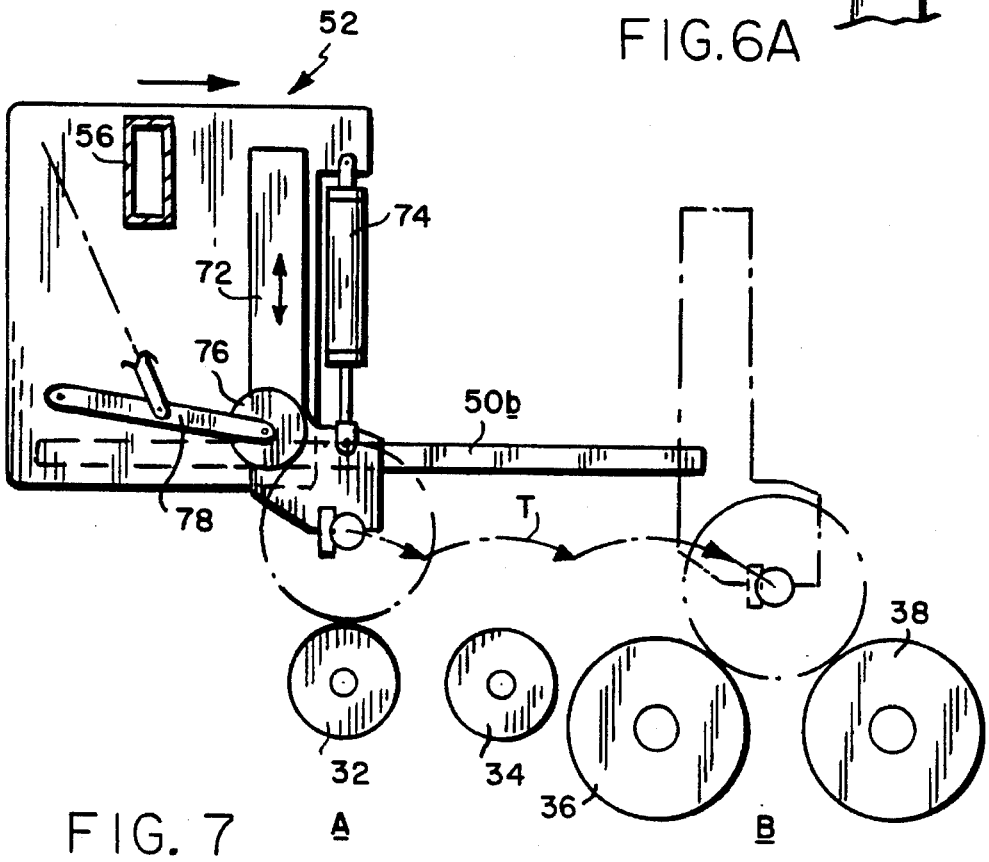
FIG. 7 is a diagrammatic illustration depicting package movement from the first winding station to the second winding station.
Figure 9:
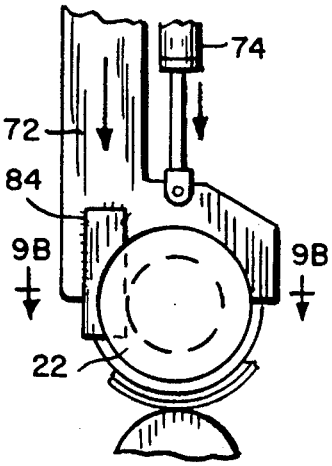
FIG. 9, 9A, 10, 10A, 11 and 11A are illustrations depicting the operation of the first and second hold down mechanisms.
Figure 9A:
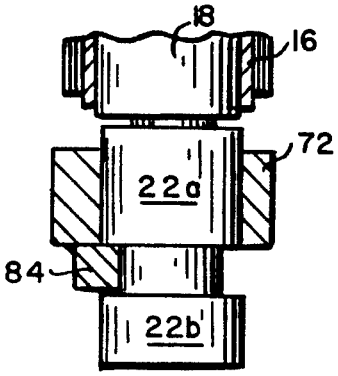

The beginning of a typical winding operation is depicted in FIG. 1, 5 and 7. A core 16 and its mandrel 18 are positioned at the first winding station A. The mandrel is urged downwardly against the first winding drum 32 by the piston-cylinder units 74 of the first hold down mechanism acting through their slide plates 72 on the inboard segments 22*a* of the mandrel end sleeves. The first rider roll 76 is in contact with the core 16 and the material being wound thereon to stabilize the winding operation. As the diameter of the wound package begins to increase, the piston-cylinder units 74 and 82 react in concert to gradually raise the slide plates 72 and the first rider roll 76. At the appropriate time, the belt drives 60 are actuated to advance the carriage 52 along transfer path P towards the second winding station B. The package moves across the underlying winding drums 32–38, and the trajectory of its rotational axis follows a path indicated diagrammatically at T in FIG. 7. Throughout this transfer from station A to station B, the wound package is continuously stabilized by the first rider roll 76 carried by the transfer carriage 52. The stabilizing action of the first rider roll 76 also resists any tendency of the mandrel to bow as its ends are pushed forwardly by the slider plates of the first hold down mechanism. At the same time, as can best be appreciated by further reference to FIGS. 9 and 9A, the mandrel 18 is held against shifting in the cross-machine direction by the first keys 84 seated in the grooves 26 in the mandrel end sleeves 22. The stabilizing action of the keys 84 stems ultimately from the fact that the transfer carriage 52 is secured against movement in the cross-machine direction by virtue of its engagement against movement in that direction with the linear bearings 58*b* running along track 50*b*. The ends of the mandrel 18 are not confined between wear plates, as is the case with conventional continuous surface winders.

Figure 8:
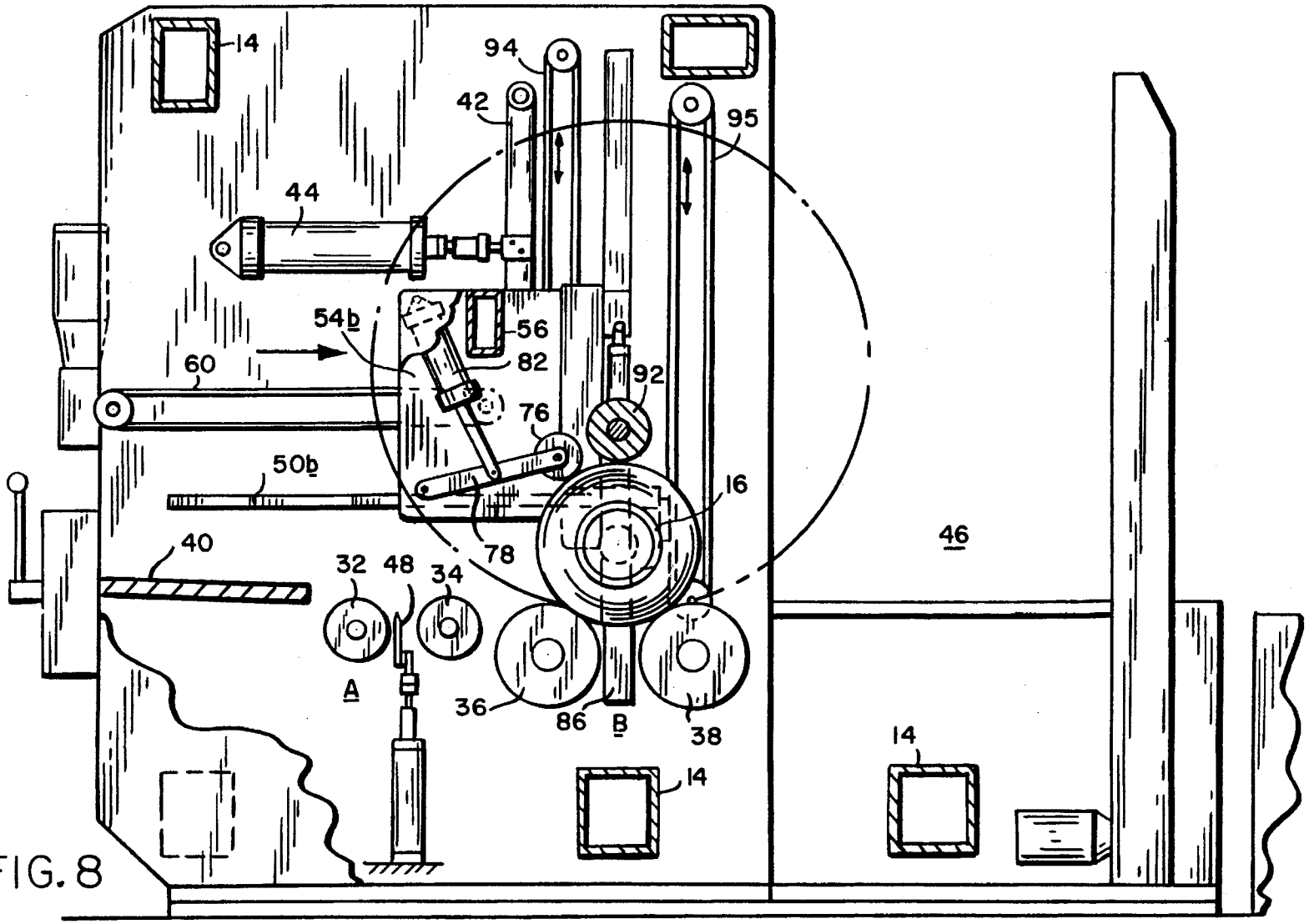
FIG. 8 is a view similar to FIG. 1 showing the package at the second winding station prior to hand off between the first and second hold down mechanisms and the first and second rider rolls.
Figure 10:
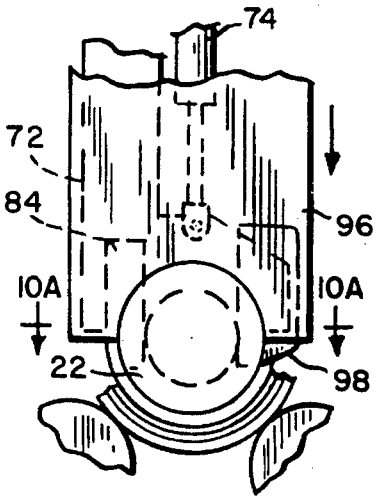
Figure 11:
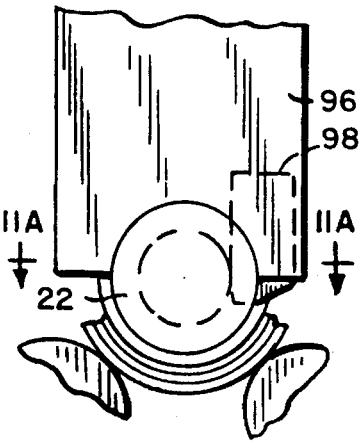
Figure 10A:
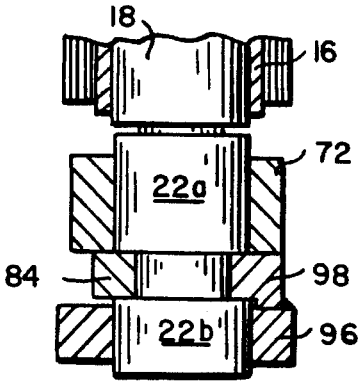
Figure 11A:
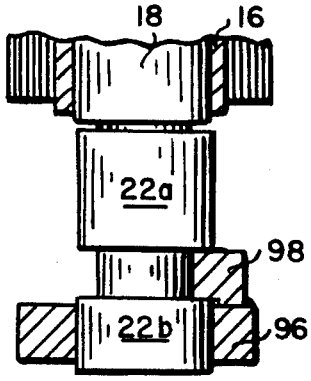

As shown in FIG. 8, after the gradually accumulating package has reached the second winding station B and is rotatably supported between winding drums 36, 38, the second hold down mechanism is actuated to lower the plates 96 and their respective second keys 98. As illustrated in FIGS. 10 and 10A, this results in the mandrel end sleeves 22 being simultaneously engaged by both the first and second hold down mechanisms. More particularly, the inboard and outboard segments 22*a*, 22*b* of the sleeves are simultaneously engaged respectively by the feet 72 of the first hold down mechanism and the plates 96 of the second hold down mechanism. At the same time, opposite sides of the grooves 26 are engaged respectively by the first and second keys 84, 98.

The second rider roll 92 is lowered by means of belt drive 95 to lend its stabilizing effect to the growing package while the first rider roll also remains in its operative position.

Once the second hold down mechanism has been actuated and the second rider roll operatively positioned, the first hold down mechanism is disengaged by raising the slide plates 72, and the first rider roll 76 is pivotally removed from the package. The transfer carriage 52 is then returned to the first winding station A, where the first hold down mechanism and the first rider roll are repositioned with respect to a fresh core and mandrel assembly. Winding continues at the second winding station B, with the package being stabilized by the second rider roll 92 and with the mandrel being axially held against shifting by the second keys 98 acting in concert with the plates 96 of the second hold down mechanism.

The winding operation continues at the second winding station until the package reaches its final diameter D. At this juncture, the cutter 48 is actuated to sever the web. The trailing end of the severed web is wound onto the package at winding station B, and the leading end of the severed web is transferred to the fresh core at the first winding station, where winding continues without interruption of web delivery to the winder. The second rider roll 92 is then removed from the finished package, and the second hold down mechanism is deactivated to free the mandrel ends. The sweep arm 42 is then operated to remove the finished package from second winding station B to the adjacent transfer station 46.

Figure 12:
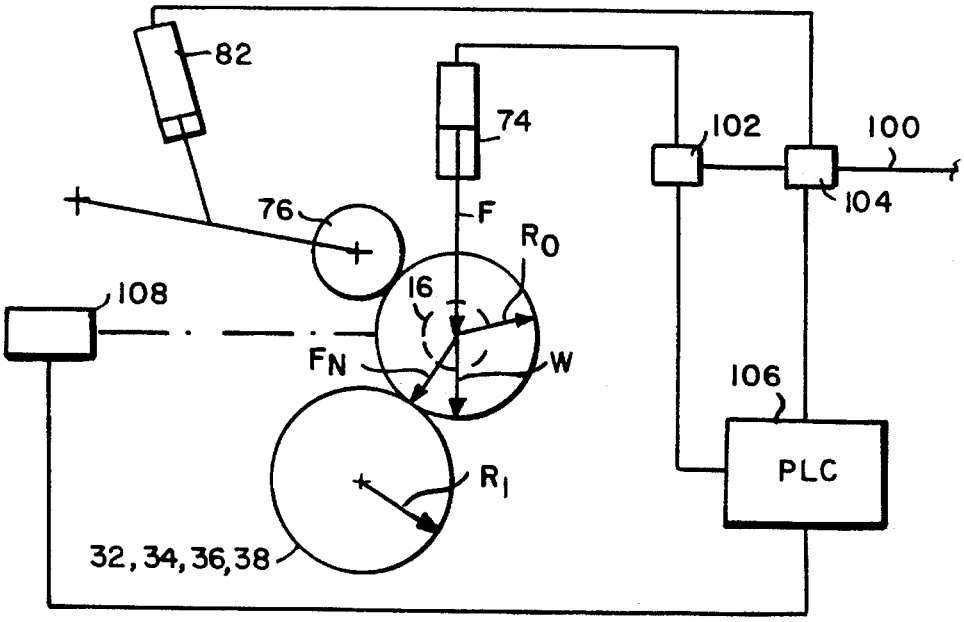
FIG. 12 is a diagrammatic illustration depicting the system for controlling the forces being exerted on the package during its transfer from the first winding station to the second winding station.

With reference to FIG. 12, it will be seen that the piston-cylinder units 74, 82 of the first hold down mechanism and the first rider roll 76 are operated by fluid pressure, e.g., compressed air, received from a line source 100 and modulated by valves 102, 104. The valves operate in response to signals received from a controller 106 which typically embodies a programmable logic circuit. Controller 106 receives signals from a package location sensor 108 which determines the horizontal position of the package along the transfer path P. The controller is programmed with the following algorithm:

$$F = F_N\left[1-\left(\frac{x}{R_1+R_0}\right)^2\right]^{1/2} - W$$

where: F is the force applied by the piston cylinder/units 74, 82;

$F_N$ is the nipping force between the package and the successive winding drums 32, 34, 36 and 38;

$R_1$ is the radius of the successive winding drums;

$R_0$ is the radius of the package;

W is the weight of the package, core and mandrel; and

X is the horizontal position of the package along the transfer path P.

The controller takes these variables into account and through valves 102, 104, modulates the forces being exerted by the piston-cylinder units 74, 82 to thereby maintain the nipping force $F_N$ within acceptable limits. Valves 102, 104 may be controlled simultaneously, or alternatively, depending on operating conditions.

In light of the foregoing, it will now be appreciated by those skilled in the art that the present invention offers a number of advantages as compared with prior art continuous surface winders. Of primary importance is the stabilization of the packages against axial movement without having to resort to the use of confining wear plates which can cause binding, which are difficult to maintain in parallel alignment, and which in any event undergo wear and thus introduce unwanted clearances. All this is avoided by locking the transfer carriage and its first hold down mechanism against movement in the cross machine direction with respect to one of the guide rails 50*b*.

Because the first rider roll 76 is carried on the transfer carriage, it can remain in contact with the package and thus lend a beneficial stabilizing effect while the package moves from the first to the second winding station.

Hold down forces and rider roll stabilization are uninterrupted during handoff at the second winding station. Nipping forces are maintained within acceptable limits. All of these factors contribute to an improved edge profile on the package material.

I claim:

1. Apparatus for continuously winding web material into a succession of rolled packages, said apparatus comprising:

a support structure having fixed mutually spaced side frames extending along opposite sides of a transfer path leading from a first winding station to a second winding station;

tubular core members onto which the web material is wound into said packages;

a plurality of rotatably driven winding drums extending between said side frames in a cross machine direction perpendicular to said transfer path, said winding drums being operative to rotatably support said cores and the packages being wound thereon during a winding operation which begins at said first winding station and which continues during transfer of said cores along said transfer path to said second winding station where the winding operation is completed;

tracks fixed to said side frames;

a transfer carriage mounted on said tracks for movement between said first and second winding stations;

bearing means for resisting shifting of said transfer carriage relative to one of said tracks in said cross machine direction and for accommodating shifting of said transfer carriage relative to the other of said tracks in the same direction;

mandrels adapted to be inserted through and to be removably fixed relative to said core members, said mandrels having opposite ends which protrude from opposite ends of said core members and which are rotatable relative to said core members;

transfer means for moving said transfer carriage in forward and reverse directions between said first and second winding stations;

first hold down means associated with said transfer carriage, said first hold down means being releasably engageable with the ends of said mandrels and being operative to yieldably urge said mandrels downwardly towards said winding drums while transporting said mandrels in said forward direction with said transfer carriage;

second hold down means for engaging and downwardly urging the ends of said mandrels at said second winding station, thereby enabling said first hold down means to be released from the ends of said mandrels and enabling said transfer means to return said transfer carriage in the reverse direction to said first winding station;

means for severing said web material at the conclusion of a roll winding operation at said second winding station, and for applying the leading end of the severed web material to another core member positioned at said first winding station; and means for removing fully wound packages from said second winding station.

2. The apparatus as claimed in claim 1 wherein the opposite ends of said mandrels are subdivided into inboard and outboard segments by circular grooves.

3. The apparatus as claimed in claim 2 wherein said first hold down means is engageable With the inboard segments of said mandrel ends.

4. The apparatus as claimed in claim 3 wherein said first hold down means includes first keys engageable with first sides of said grooves.

5. The apparatus as claimed in claim 4 wherein said second hold down means is engageable with the outboard segments of said mandrel ends.

6. The apparatus as claimed in claim 5 wherein said second hold down means includes second keys engageable with second sides of said grooves.

7. The apparatus as claimed in claim 1 further comprising a first rider roll pivotally mounted on said transfer carriage, and means associated with said carriage for adjustably applying said first rider roll to packages being wound at and during transfer from said first winding station.

8. The apparatus as claimed in claim 7 further comprising a second rider roll at said second winding station, and means for adjustably applying said second rider roll to packages being wound at said second winding station.

9. The apparatus as claimed in claim 8 wherein said first and second rider rolls are applicable simultaneously to a package being wound at said second winding station.

10. The apparatus as claimed in claim 9 wherein said first and second hold down means are applicable simultaneously to a package being wound at said second winding station.

11. The apparatus as claimed in claim 1 further comprising means for modulating the forces being applied to said packages by said first hold down means during transfer of said packages from said first winding station to said second winding station to thereby maintain the nipping pressure with which said packages are held against said winding drums within predetermined limits.

12. The apparatus as claimed in claim 7 further comprising means for modulating the forces being applied to said packages by said first rider roll during transfer of said packages from said first winding station to said second winding station to thereby maintain the nipping pressure with which said packages are held against said winding drums within predetermined limits.

13. Apparatus for continuously winding web material into a succession of rolls, said apparatus comprising:

a support structure having fixed mutually spaced side frames extending along opposite sides of a transfer path leading from a first winding station to a second winding station;

tubular core members onto which the web material is wound into said rolls;

a plurality of rotatably driven winding drums extending between said side frames in a cross machine direction perpendicular to said transfer path, said winding drums being operative to rotatably support said cores and the web material being wound thereon during a winding operation which begins at said first winding station and which continues during transfer of said cores along said transfer path to said second winding station where the winding operation is completed;

tracks fixed to said side frames;

a transfer carriage mounted on said tracks for movement between said first and second winding stations;

a first rider roll mounted on said transfer carriage;

means associated with said carriage for adjustably applying said first rider roll to a package being wound on said core members at said first winding station and during transfer of said packages to said second winding station;

a second rider roll at said second winding station;

means for adjustably applying said second rider roll to packages being wound at said second winding station, said first and second rider rolls being simultaneously applicable to packages at said second winding station;

means for severing said web material at the conclusion of a roll winding operation at said second winding station, and for applying the leading end of the severed web material to another core member positioned at said first winding station; and means for removing fully wound rolls from said second winding station.

* * * * *